US009204692B2

(12) United States Patent
Lee

(10) Patent No.: US 9,204,692 B2
(45) Date of Patent: Dec. 8, 2015

(54) QUICK RELEASE BUCKLE

(71) Applicant: LEON SPORTS LTD., Wuxi, Jiangsu (CN)

(72) Inventor: William Lee, Taipei (TW)

(73) Assignees: Leon Sports Ltd., Jiangsu (CN); William Lee, Taipei (TW)

( * ) Notice: Subject to any disclaimer, the term of this patent is extended or adjusted under 35 U.S.C. 154(b) by 61 days.

(21) Appl. No.: 13/900,391

(22) Filed: May 22, 2013

(65) Prior Publication Data

US 2014/0345096 A1 Nov. 27, 2014

(51) Int. Cl.
*A44B 11/25* (2006.01)

(52) U.S. Cl.
CPC ..... *A44B 11/2592* (2013.01); *Y10T 24/45482* (2015.01); *Y10T 24/45529* (2015.01); *Y10T 24/45581* (2015.01)

(58) Field of Classification Search
USPC ..... 24/630, 633, 634, 636, 641, 646, 647, 24/648, 606, 616, 625, 664, 597, 593.1, 24/594.1, 614, 637
See application file for complete search history.

(56) References Cited

U.S. PATENT DOCUMENTS

| | | | | |
|---|---|---|---|---|
| 4,831,694 | A | 5/1989 | Kong | |
| 5,222,279 | A | 6/1993 | Frano et al. | |
| 5,465,472 | A | 11/1995 | Matoba | |
| 6,030,147 | A | 2/2000 | Bowden | |
| 6,487,761 | B2 | 12/2002 | Van Tassel | |
| 6,527,480 | B2 | 3/2003 | Angelini et al. | |
| 7,073,234 | B2 | 7/2006 | Turpin | |
| 8,191,213 | B2 * | 6/2012 | Anscher | 24/647 |
| 8,196,273 | B2 * | 6/2012 | Anscher | 24/606 |
| 8,522,410 | B2 * | 9/2013 | Parisi et al. | 24/634 |
| 2002/0092140 | A1 * | 7/2002 | Van Tassel | 24/614 |
| 2010/0313392 | A1 * | 12/2010 | Anscher | 24/616 |
| 2011/0219590 | A1 * | 9/2011 | Anscher | 24/606 |
| 2011/0239419 | A1 * | 10/2011 | Carter | 24/606 |

* cited by examiner

*Primary Examiner* — Robert J Sandy
*Assistant Examiner* — Michael Lee
(74) *Attorney, Agent, or Firm* — Muncy, Geissler, Olds & Lowe, P.C.

(57) ABSTRACT

A quick release buckle is revealed. The quick release buckle includes a male member, a female member and a pulling member. The male member consists of two symmetrical legs that can be deformed elastically and a U-shaped part disposed between the two legs. Two ends of one side of the U-shaped part with an opening are respectively connected to each of the two legs. The female member is inserted by and locked with the male member while the pulling member is connected to the U-shaped part of the male member. When users pull the pulling member out, two ends of the U-shaped part with the opening are deformed inward. Thus the two legs are further driven to be deformed inward. Therefore the male member is pulled out of the female member.

10 Claims, 7 Drawing Sheets

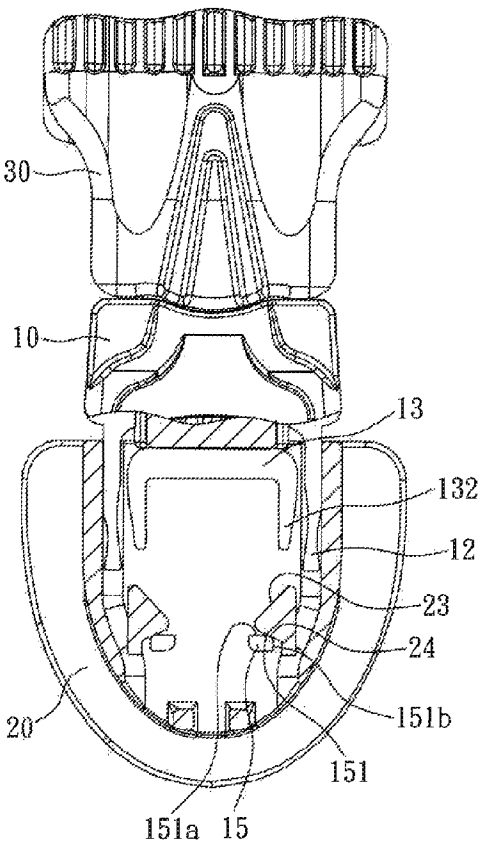
FIG. 6
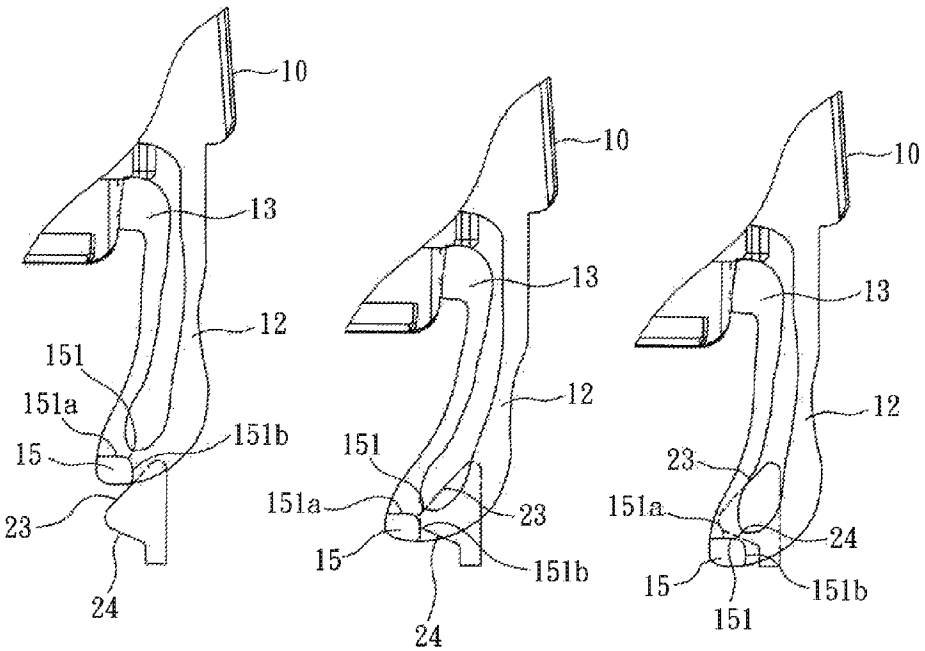
FIG. 7
FIG. 8
FIG. 9

QUICK RELEASE BUCKLE

BACKGROUND OF THE INVENTION

The present invention relates to a buckle, especially to a quick release buckle used in diving equipment or others.

A conventional buckle generally includes a male tongue and a female buckle. The male tongue snaps into or separated from the female buckle. The male tongue is formed by a tongue body and a pair of flexible legs arranged at two sides of the tongue body respectively. An operation part and a locking part are disposed on a front end of each leg. The female buckle consists of a buckle body and an insertion hole formed on the buckle body to be inserted by the male tongue. The insertion hole is arranged with a leaning part, a locked part, and lateral openings. The leaning part is against by the legs of the male tongue so as to make the legs move elastically while the locked part is locked with the locking part of the leg. The operation part of the leg is exposed out of the lateral opening. While the male tongue being disassembled from the female buckle, first the operation part of the leg exposed out of the lateral opening of the insertion hole is pressed inward to be moved inward and elastically. Thus the locking part of the male tongue is separated from the locked part of the insertion hole. Then the male tongue is pulled out of the female buckle. The main shortcoming of the conventional buckle is in that the separation of the male tongue from the female buckle needs two steps. First the exposed leg is pressed inward so as to make the locking part of the male tongue and the locked part of the female buckle separate from each other. Then the male tongue is pulled out.

Refer to U.S. Pat. No. 5,465,472, U.S. Pat. No. 4,831,694 and U.S. Pat. No. 5,222,279, the shortcoming of the buckle revealed in these patents is that the separation of a male part from a female part takes two steps. An operation part of each of two elastic arms of the male part is pressed inward so that a locking part of the male part is separated from a locked part of the female part. Then the male part is pulled out of an insertion hole of the female part.

Refer to U.S. Pat. No. 6,527,480, a buoyancy compensator weight system is revealed. The shortcoming thereof is that there are two steps for disconnection of connector portions. Firstly resilient prongs of two elastic arms of a male part are squeezed inwardly. Then connector portions are disconnected from each other. However, connector portions are easily disconnected while being pinched or squeezed and users are in danger.

Refer to U.S. Pat. No. 6,030,147, "Torso-conforming releasable divers weight pouch" is provided for rapid release of diving weights. Weight pouch is secured to a buoyancy compensator vest by VELCRO. The disadvantage of such design is in that VELCRO® brand hook is easy to get broken after long time use. And the surface of the VELCRO® brand hook may be attached with some debris so that the adhesion performance is reduced. Thus weight pouch is easy to slip off and the user is in danger while diving.

Refer to U.S. Pat. No. 6,487,761, a quick release buckle for divers is revealed. The quick release buckle includes a female buckle member, a male buckle member, and an elongated pull element. The female buckle member has an end opening and lateral openings while the male buckle member has deformable spring arms with at least one protuberance. The elongated pull element is connected to the spring arms of the male buckle member. Engagement of the male and female buckle members is effected by the spring arms of the male buckle member extending laterally outwardly through lateral openings in the female buckle member after the spring arms are inserted through the end opening in the female buckle member. Disengagement of the male buckle member from the female buckle member is effected by pulling the elongated pull element outwardly to deform the spring arms and urge the protuberance of the male buckle member inwardly. Thus the protuberance is released from the lateral opening of the female buckle member. However, the spring arms of the male buckle member are quite easy to be affected by a pulling force and objects connected thereof. While being affected by the pulling force and/or objects connected, the spring arms of the male buckle member are easy to deform inward. Thus the male and female buckle members are easy to disengaged from each other.

Refer to U.S. Pat. No. 7,073,234, a quick-release buckle designed for use in underwater operations as a buckle on swimming and diving gear is revealed. The quick-release buckle includes a male buckle and a female buckle. The male buckle and the female buckle are connected to each other by an abruptly rising wall of a tongue of the male buckle received in an aperture of the female buckle. But the quick-release buckle is easy to be affected by a pulling force and/or objects connected thereof. The tongue of the male buckle is easily moved inwards so that the male buckle and the female buckle are disassembled. In order to solve the above problem, the abruptly rising wall of the tongue is produced more exposed for being locked with the aperture more tightly. Thus the joint strength of the male buckle and female buckle is improved. However, users need to apply more force while assembling or disassembling the male buckle and the female buckle. This is inconvenient to operate in some emergency conditions.

SUMMARY OF THE INVENTION

Therefore it is a primary object of the present invention to provide a quick release buckle that overcomes the shortcoming of conventional buckles that require two steps while separating a male member and a female member thereof from each other. Moreover, the operation of the quick release buckle during assembling and disassembling is improved. While being pulled out by a pulling force and/or an object connected to the buckle, the male member and the female member are connected with each other more tightly, getting more difficult to be separated from each other.

In order to achieve the above object, a quick release buckle of the present invention consists of a male member, a female member and a pulling member. The male member includes a base and two legs arranged symmetrically on the left side and right side on a front end of the base, extended along an insertion direction of the male member and able to be deformed elastically. Each leg is disposed with a locking part used for being locked with the female member. A U-shaped part is arranged between the two legs and two ends of one side thereof with an opening are respectively connected to each of the two legs. The female member includes a receiving space. The receiving space is disposed with a locked part corresponding to and locked with the locking part of the male member. The pulling member is connected to the bottom of the U-shaped part of the male member. Thereby the two legs are deformed inward and elastically when the U-shaped part is pulled along the pull-out direction of the male member. Thus the male member is pulled out of the female member. While a force in the pull-out direction of the male member being applied to and/or weight of an object connected to the male member acted on the base of the male member, the two legs are deformed outward and elastically. Thus the connection between the male and female members is getting tighter.

BRIEF DESCRIPTION OF THE DRAWINGS

FIG. 6 is a partial cross sectional view of an assembled embodiment according to the present invention;

FIG. 7, FIG. 8 and FIG. 9 are schematic drawings showing insertion and pulling of an embodiment according to the present invention;

DETAILED DESCRIPTION OF THE PREFERRED EMBODIMENT

Figure 1:
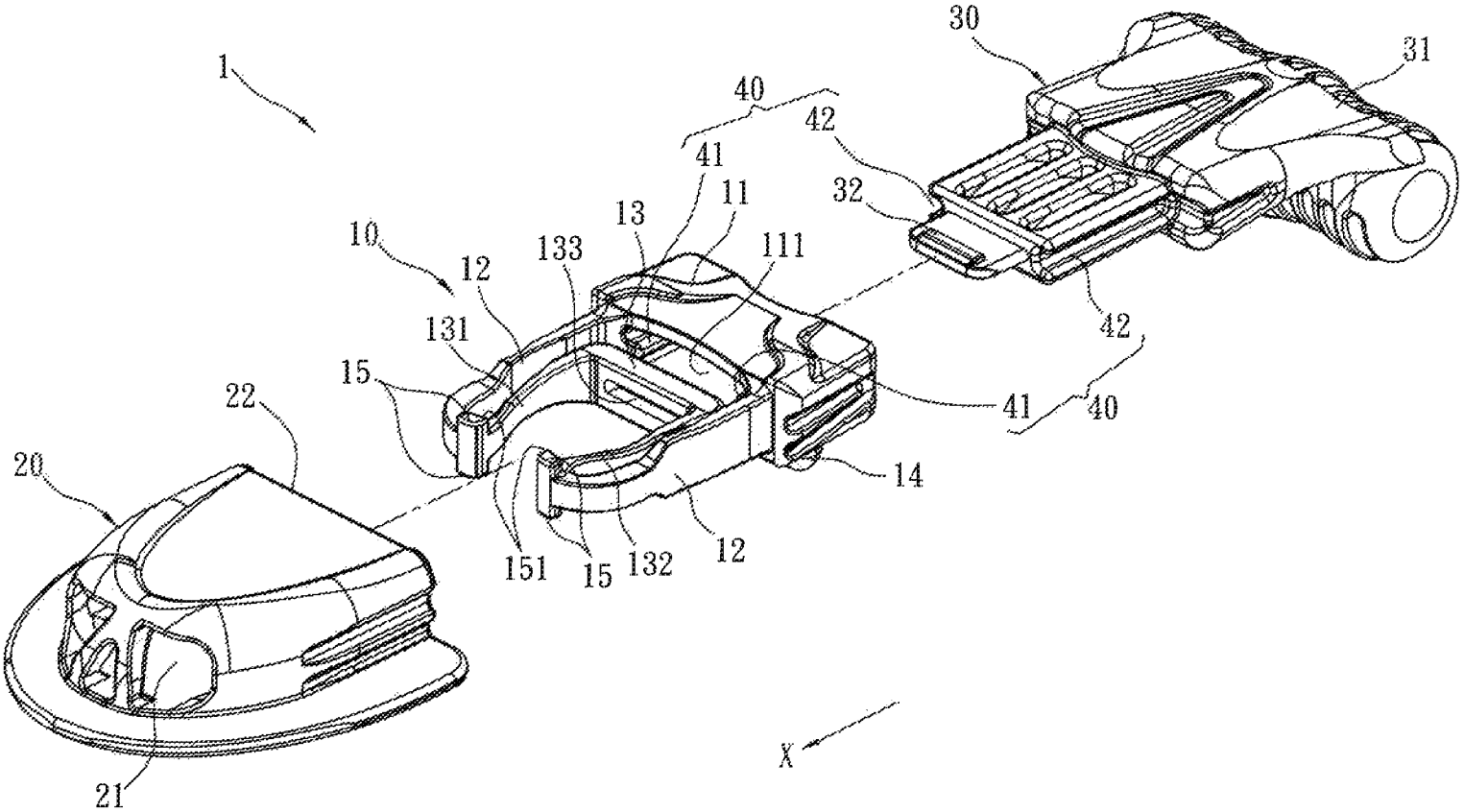
FIG. 1 is an explosive view of an embodiment according to the present invention.
Figure 2:
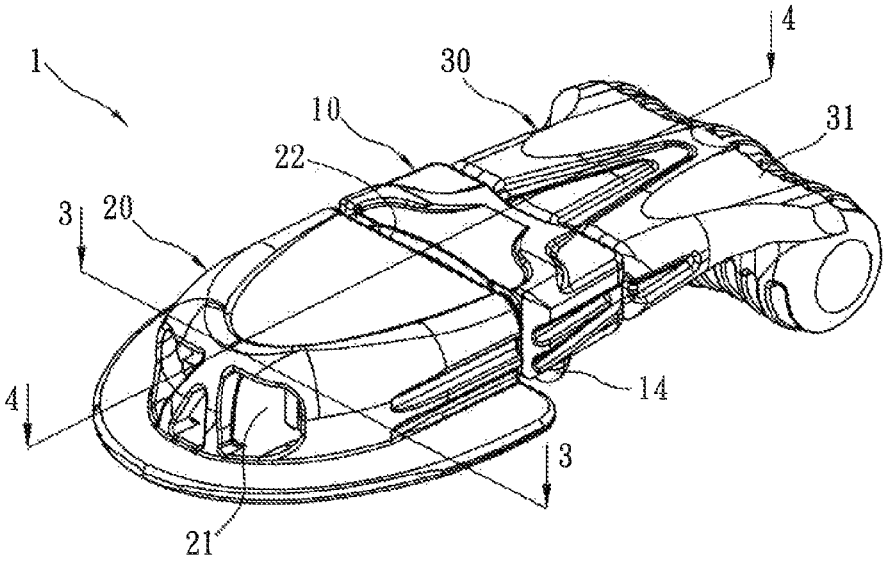
FIG. 2 is an assembled view of an embodiment according to the present invention.

Refer from FIG. 1 to FIG. 4, a quick release buckle 1 of the present invention includes a male member 10, a female member 20 and a pulling member 30. These components can be, but not limited to, made from synthetic resins materials and produced into an integral part by injection molding. They can also be made of metal and produced by other molding methods.

The male member 10 consists of a base 11, a pair of legs 12, and a U-shaped part 13. The two legs 12 are made from elastic material, able to be deformed, being arranged symmetrically on the left side and right side of the base 11 and extended along an insertion direction of the male member 10 (as an arrow X indicated). The insertion direction X of the male member 10 means the direction from the male member 10 toward the female member 20. The U-shaped part 13 is composed of a left leg piece 131 and a right leg piece 132 respectively connected to a front end of each leg 12 and able to be deformed elastically. One end of the pulling member 30 is inserted into an installation part 133 to be positioned therein while the installation part 133 is in a central part of the U-shaped part 13. The installation part 133 can be a hole penetrating and located in a central part of the U-shaped part 13.

A penetrating through hole 111 is mounted in the base 11, allowing one end of the pulling member 30 passing through to be positioned on the installation part 133 of the U-shaped part 13. At least one fixing hole 14 is disposed on a bottom surface of the base 11, allowing insertion of strings or webbings for fixing the male part 10. By the fixing hole 14, the base 11 of the male member 10 is connected to weight pouch or other objects such as clothes, bags, helmets, etc.

The two legs 12 respectively are linearly extended from two sides of the base 11 along the insertion direction X of the male part 10. The front end of the leg 12 is bent inwardly so that the leg 12 is in a curved form. A top surface and a bottom surface of the front end of the leg 12 are projecting so as to form a locking part 15 and the locking part 15 is located on an inner side of the front end of the leg 12. An insertion guide surface 151 is formed around edges of an outer side of the locking part 15. The insertion guide surface 151 includes a flat surface 151*a* perpendicular to the insertion direction X of the male member 10 and a flat surface 151*b* parallel to the insertion direction X of the male member 10 (as shown in FIG. 6).

Figure 3:
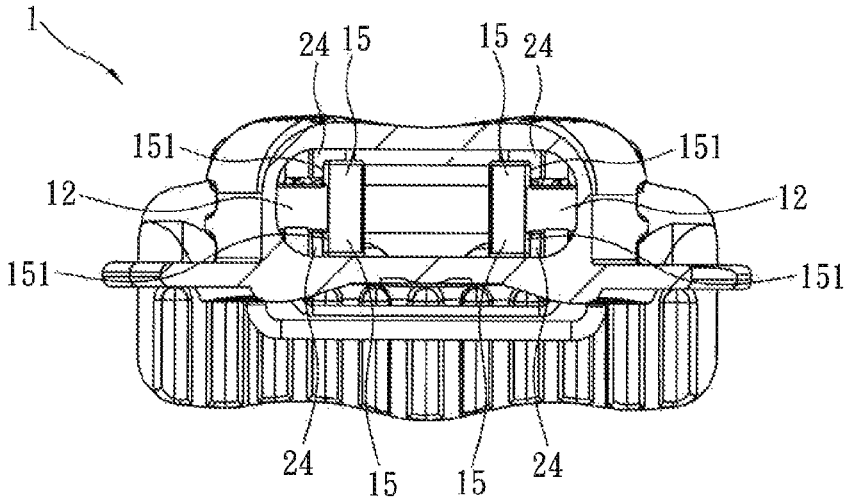
FIG. 3 is a cross sectional view of the embodiment in FIG. 2 along a 3-3 line according to the present invention.
Figure 4:
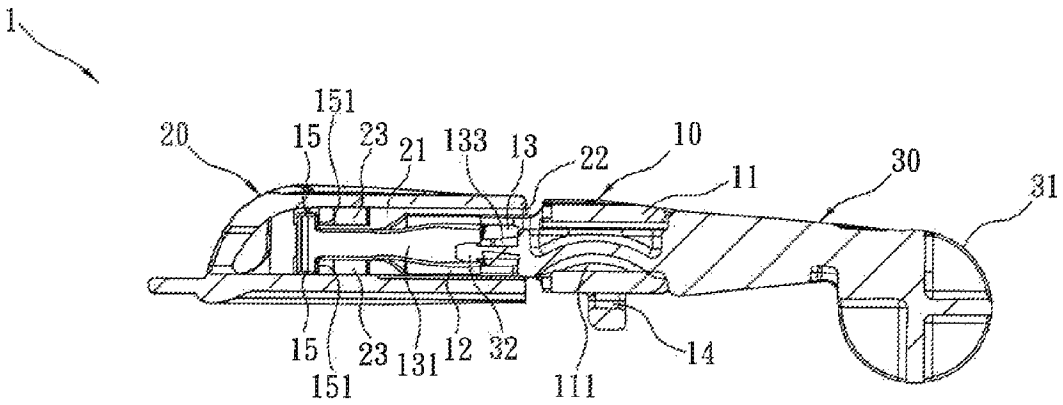
FIG. 4 is a cross sectional view of the embodiment in FIG. 2 along a 4-4 line according to the present invention.
Figure 5:
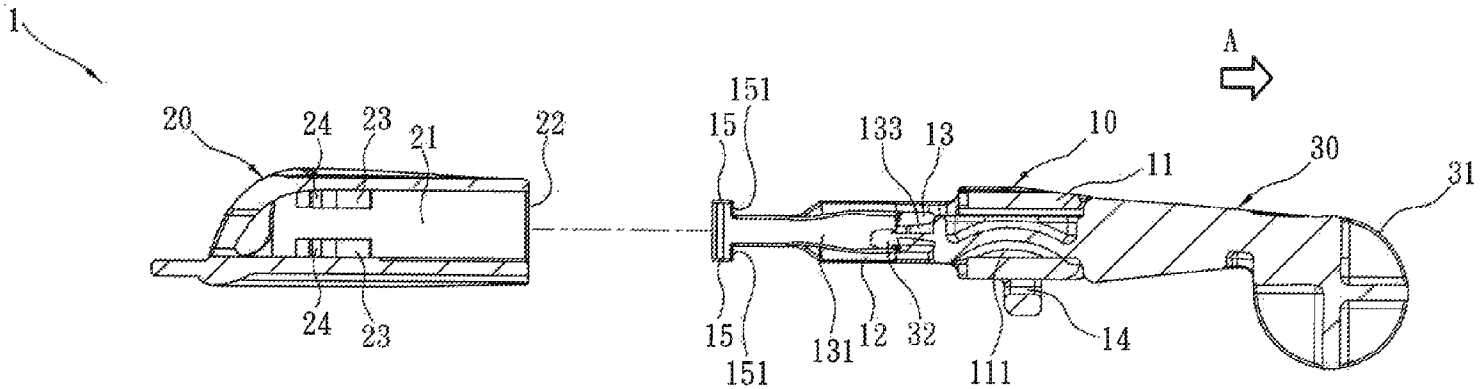
FIG. 5 is a schematic drawing showing a male member and a female member of the embodiment in FIG. 4 separated from each other according to the present invention.

The female member 20 is a flat cylindrical body and having a receiving space 21 and an opening 22. The leg 12 and the U-shaped part 13 of the male member 10 pass the opening 22 and insert into the receiving space 21. An upper sidewall and a lower sidewall inside the receiving space 21 are arranged with a pair of symmetrical leaning and contact part 23, as shown in FIG. 4, FIG. 5 and FIG. 6. Each pair of the leaning and contact part 23 is leaning against and in contact with the insertion guide surface 151 of the locking part 15 so that the leg 12 is deformed elastically and inwardly. Moreover, a locked part 24 is formed in the female member 20, located inner than the leaning and contact part 23 (as shown in FIG. 3, FIG. 4 and FIG. 6) and is corresponding to the locking part 15 of the leg 12. By the locked part 24 of the leaning and contact part 23 and the locking part 15 of the leg 12 locked with each other, the male member 10 and the female member 20 are fastened with each other.

One end of the pulling member 30 is disposed with a holding part 31 that is hold by user's hand while the other end thereof is passed through the through hole 111 of the base 11 of the male member 10 to be connected to the U-shaped part 13 of the male part 10. The pulling member 30 can also be joined with the U-shaped part 13 by a webbing. When the pulling member 30 and the U-shaped part 13 are pulled out along a pull-out direction of the male member 10, the left leg piece 131 and the right leg piece 132 of the U-shaped part 13 drive the front end of each leg 12 to move inwardly and deform elastically so that the locking part 15 of the leg 12 is released from the locked part 24 of the female member 20. Thus the male member 10 is pulled out of the female member 20.

Refer to FIG. 4 and FIG. 6, while the male member 10 being inserted into the receiving space 21 of the female member 20, the locking part 15 of the leg 12 is locked with the locked part 24 of the female member 20. Refer to FIG. 5, when the pulling member 30 is pulled along the pull-out direction of the male member 10 (as an arrow A indicated), the locking part 15 is released from the locked part 24. Thus the male member 10 is pulled out of the female member 20. The locked state of the male member 10 as shown in FIG. 4 is changed into the released state.

Refer to FIG. 7, the insertion guide surface 151 of the locking part 15 on the front end of the leg 12 can be leaning against the leaning and contact part 23 of the female member 20 so that the legs 12 are deformed elastically, inwardly and inserted deeper into the female member 20, as shown in FIG. 8. The leg 12 is deformed inwardly and elastically around the end near the base 11. It takes a little effort to operate and deform the leg 12 and the buckle is easy to use.

When the locking part 15 of the leg 12 of the male member 10 is inserted deeper into and over the locked part 24 of the female member 20, inwardly-elastically-deformed legs 12 is elastically moved outward and turned back to the original state, as shown in the FIG. 9. Thus the locking part 15 of the leg 12 is locked with the locked part 24 of the female member 20. Therefore the male member 10 and the female member 20 are joined with each other.

When the male member 10 is disassembled from the female member 20, the pulling member 30 is pulled along the pull direction of the male part (the arrow A indicated in FIG. 5). Due to the pulling force, the U-shaped part 13 is moved outward. The left leg piece 131 and the right leg piece 132 are driven to move simultaneously and push the leg 12 of the male member 10 to deform inward and elastically. Thus the locking part 15 is released from the locked part 24. Therefore the male member 10 and the female member 20 are separated from each other.

When the male member 10 and the female member 20 are in the locked state, the locking part 15 of the male member 10 and the locked part 24 of the female member 20 are against each other. When a weight pouch is fixed on the male member 10 by the fixing hole 14, the weight of the weight pouch acts on the base 11 of the male member 10 to pull the male member 10 along the pull-out direction. At the same time, the two legs 12 of the male member 10 are also driven to move along the same direction. Due to the pulling force, the top end on each of the two legs 12 of the male member 10 is deformed outward and elastically. Due to that the locking part 15 against the locked part 24 and located on inner side of each leg 12, the locking part 15 is also acted by an outward force. Thus both the leg 12 and the locking part 15 are moved outward. The male member 10 and the female member 20 are fastened with each other more tightly. If a pulling force is applied to the base 11, the male member 10 and the female member 20 are also connected to each other more firmly.

Refer to FIG. 1, the quick release buckle 1 further includes an alignment member 40 disposed between the male member 10 and the pulling member 30 (is arranged on male member 10 and pulling member 30). The alignment member 40 includes two guide blocks 41 and two guide slots 42. The guide blocks 41 and the guide slots 42 are corresponding to each other and are arranged on the male member 10 and the pulling member 30 respectively. The two guide blocks 41 are disposed symmetrically on the left sidewall and the right sidewall of the through hole 111 of the base 11 while the two guide slots 42 are arranged at the left outer sidewall and the right outer sidewall of the pulling member 30, along the direction the pulling member 30 being mounted into the male part 10. The positions of the guide blocks 41 and the positions of the guide slots 42 can be exchanged. The two guide blocks 41 are set on the pulling member 30 while the two guide slots 42 are mounted in the male member 10 (not shown in figure). Due to the alignment member 40, the two guide blocks 41 are moved along the two guide slots 42 respectively while the male member 10 and the pulling member 30 are assembled with each other. Thus the pulling member 30 is mounted into the male member 10 smoothly.

Refer to FIG. 1, a fastening part 32 is disposed on one end of the pulling member 30, opposite to the end with the holding part 31. The fastening part 32 is passed through the installation part 133 of the U-shaped part 13 to be locked and positioned in the installation part 133.

Figures 10, 11:
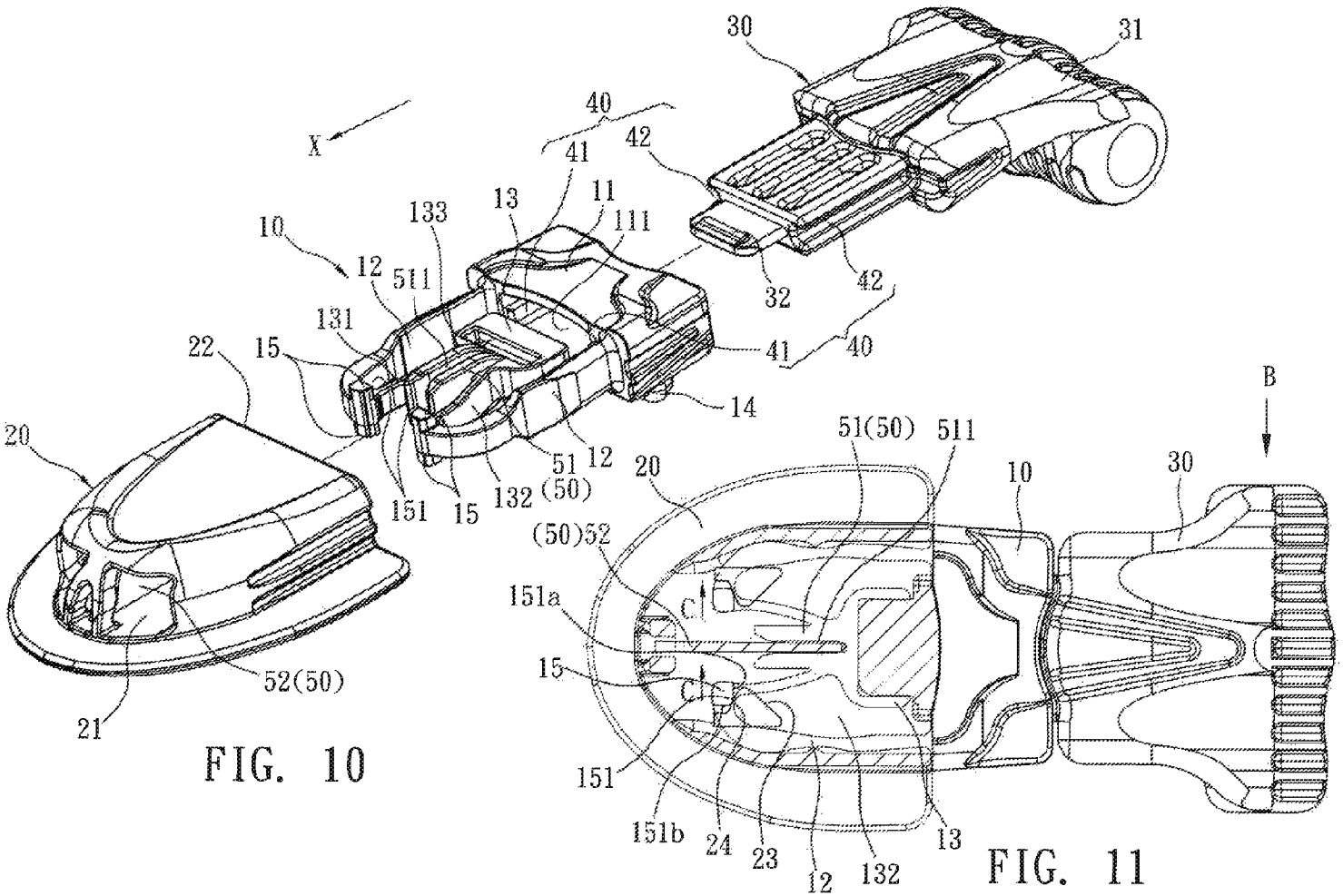
FIG. 10 is an explosive view of another embodiment according to the present invention.
FIG. 11 is a schematic drawing showing a male member and a female member assembled with each other of the embodiment in FIG. 10 according to the present invention.

Refer to FIG. 10 and FIG. 11, a guide member 50 is arranged on the male member 10 and the female member 20 respectively. The guide member 50 is formed by a guide part 51 and a guide wall 52. The guide part 51 is disposed on the U-shaped part 13 of the male member 10 and is extended along the insertion direction of the male member 10 (as the arrow X indicated) with a proper length. A guide slot 511 is arranged at the guide part 51 along the length direction of the guide part 51. The opening of the guide slot 511 faces the insertion direction of the male member 10. The guide wall 52 is fixed on the receiving space 21 of the female member 20, corresponding to and mounted in the guide slot 511 of the guide part 51. By the guide wall 52 being moved in the guide slot 511 of the guide part 51, the legs 12 of the male member 10 are mounted into the female member 20 precisely.

Refer to FIG. 11, while the male member 10 and the female member 20 are connected, not only the locking part 15 on the leg 12 of the male member 10 is locked with the locked part 24 of the female member 20, the guide wall 52 is also mounted in the guide slot 511 of the guide part 51. When the pulling member 30 is pressed in the direction an arrow B indicated, the locking part 15 on the leg 12 of the male member 10 is moved upward (as an arrow C indicated). Due to the limitation of the guide wall 52 of the female member 20, the locking part 15 of the male member 10 and the locked part 24 of the female member 20 are unable to be separated from each other. The male member 10 and the female member 20 are still connected with each other tightly. Moreover, when a force is applied to the direction opposite to the direction the arrow B indicated, the male member 10 and the female member 20 still can't be separated.

Figure 12:
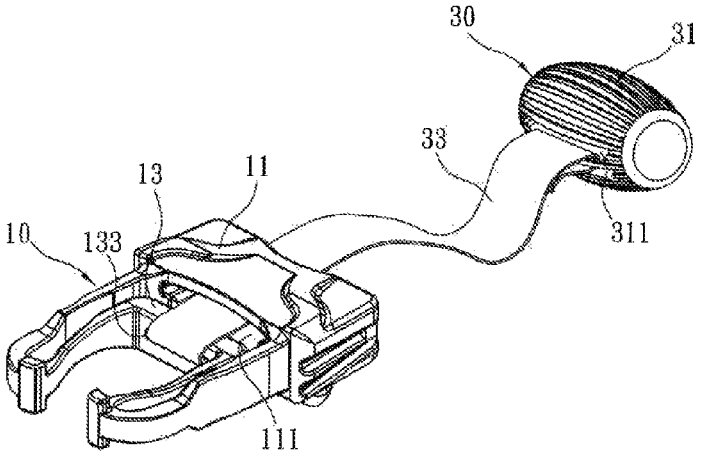
FIG. 12 is a schematic drawing showing connection between a pulling member and a U-shaped part of a male member of an embodiment according to the present invention.

Refer to FIG. 12, the pulling member 30 and the male member 10 are connected by a webbing 33. One end of the webbing 33 is connected to a mounting slot 311 of the holding part 31 while the other end thereof is passed the through hole 111 of the base 11 to be wound and positioned at the installation part 133 of the U-shaped part 13.

Figure 13:
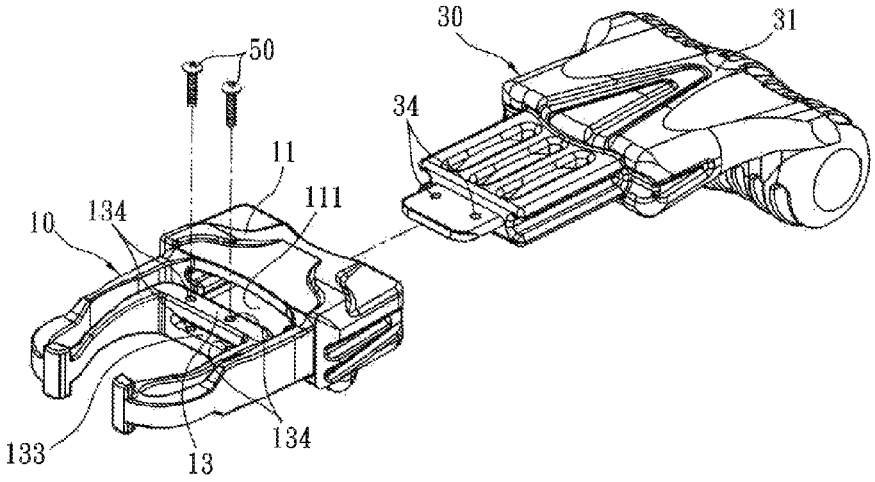
FIG. 13 is a schematic drawing showing connection between a pulling member and a U-shaped part of a male member of an embodiment according to the present invention.

Refer to FIG. 13, one end of the pulling member 30, opposite to the end with the holding part 31, is disposed with tapped hole 34. The upper part and the lower part of the installation part 133 on the U-shaped part 13 of the male member 10 are also mounted with tapped holes 134 corresponding to the tapped holes 34. Screws 50 are passed through the tapped holes 34 and the tapped holes 134. After the end of the pulling member 30 opposite to the end with the holding part 31 being inserted through the through hole 111 of the male member 10 and entered the installation part 133 of the U-shaped part 13, the pulling member 30 and the male member 10 are fastened by the screws 50.

Figure 14:
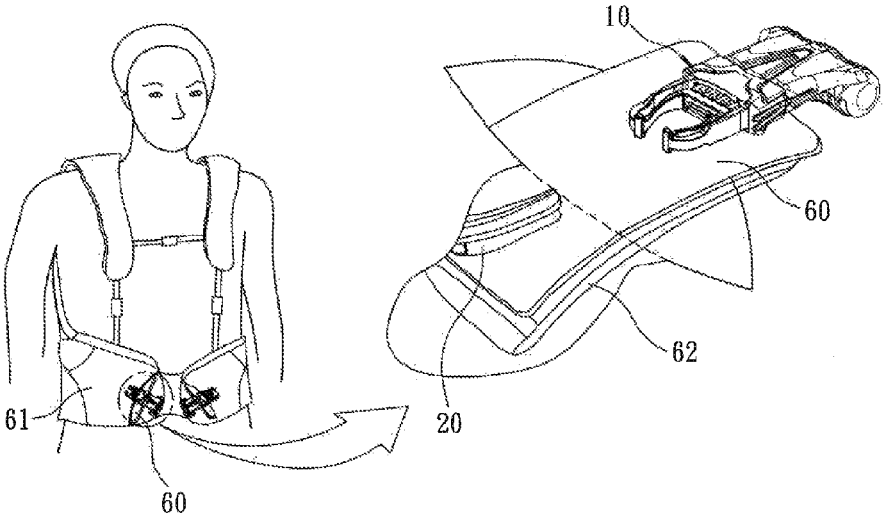
FIG. 14 is a schematic drawing showing a male member of an embodiment disposed on a weight pocket according to the present invention.
Figure 15:
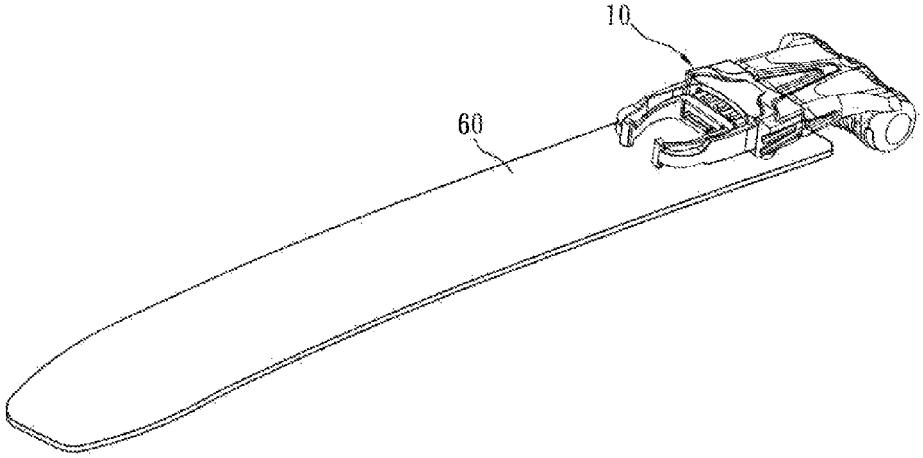
FIG. 15 is a schematic drawing showing a male member of an embodiment disposed on a piece-like body according to the present invention.

In the above embodiment, the male member 10 can also be fixed directly on other devices, as shown in FIG. 14. For example, the base 11 of the male member 10 can be connected to weight pouches 62 in a weight pocket 61 of a scuba weight system for Buoyancy control by a piece-like body 60. Or the base 11 of the male member 10 can be connected to a quick-release system for the weights in scuba diving. Thus users can release the male member 10 by one operation quickly. As to the female member 20, it is mounted in the weight pocket 61 corresponding to the male member 10. The male member 10 and the piece-like body 60 are integrally formed, as shown in FIG. 15. Then the piece-like body 60 is connected to the weight pocket 61 by many ways such as sewing, glue or threads.

In the lock state, when the pulling force in the pull-out direction of the male member 10 and/or an acting force of the object connected to the male member 10 is applied to the base 11 of the male member 10, the two legs 12 are deformed elastically and outward. Thus the male member 10 and the female member 20 are connected with each other more tightly. Thus the buckle will not be released unintentionally due to the weight of the weight pouch or the pulling force.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A quick release buckle comprising:

a male member that is inserted into, locked with a female member, and having:

a base;

two legs symmetrically disposed on the left side and the right side of the base, extending toward an insertion direction of the male member, and able to be deformed elastically; a front end of each of the two legs is curved inward; a top surface and a bottom surface of the front end of each of the two legs projecting outward so as to form a locking part and the locking part being located on an inner side of the front end of each of the two legs; an insertion guide surface being formed around edges of an outer side of the locking part;

a U-shaped part arranged between the two legs and having a left leg piece, a right leg piece, and a central part, the left leg piece and the right leg piece respectively connected to a front end of each of the two legs, and the central part having an installation feature therein, the central part connecting a rear end of each of the two legs of the U-shaped part;

a female member being a flat cylindrical body and having a receiving space and an opening for the two legs and the U-shaped part of the male member to pass through the opening and insert into the receiving space; an upper sidewall and a lower sidewall inside the receiving space being arranged with a pair of symmetrical leaning and contact parts, each pair of leaning and contact parts leaning against and in contact with the insertion guide surface of the locking part so that each of the two legs is deformed elastically and inwardly; a locked part is formed in the female member, located inner than the leaning and contact parts and being corresponding to the locking part of each of the two legs; when the locked part of the leaning and contact parts and the locking part of each of the two legs are locked with each other, the male member and the female member are fastened with each other; and a pulling member is connected to the installation feature of the central part of the U-shaped part of the male part;

wherein the left leg piece and the right leg piece of the U-shaped part drive the two legs to move inward and deform elastically so that the male member is pulled out of the female member when a pulling force is applied to the pulling member connected to the installation feature in a pull-out direction of the male member.

2. The quick release buckle as claimed in claim 1, wherein two guide blocks are disposed symmetrically on a left sidewall and a right sidewall of a through hole on the base of the male member, and two guide slots are arranged at a left outer sidewall and a right outer sidewall of the pulling member, along the direction of the pulling member being mounted into the male part; the two guide blocks are mounted in and moved along the two guide slots correspondingly for providing alignment between the male member and the pulling member.

3. The quick release buckle as claimed in claim 1, wherein one end of the pulling member is disposed with a holding part used for being held by a user's hand while the other end of the pulling member is arranged with a fastening part used for being locked in the installation feature.

4. The quick release buckle as claimed in claim 1, wherein the pulling member and the male member are fastened by screws when the pulling member is connected to the installation feature of the U-shaped part of the male member.

5. The quick release buckle as claimed in claim 3, wherein the pulling member and the male member are further connected by a webbing; one end of the webbing is connected to a mounting slot of the holding part while the other end thereof is connected to the installation feature of the U-shaped part of the male member.

6. The quick release buckle as claimed in claim 1, wherein the male member is connected to a weight pocket by strings or webbings inserted through a fixing hole on the base of the male member.

7. The quick release buckle as claimed in claim 6, wherein the male member and the weight pocket are connected by a piece-like body; the male member and the piece-like body are integrally formed while the weight pocket is connected to the piece-like body by sewing, glue or threads.

8. The quick release buckle as claimed in claim 1, wherein a guide part is disposed on the U-shaped part of the male member and is extended along the insertion direction of the male member with a proper length thereof while a guide slot is arranged at the guide part along a length direction of the guide part and an opening of the guide slot faces the insertion direction of the male member; a guide wall is fixed in the receiving space of the female member, corresponding to and mounted in the guide slot of the guide part for guiding the insertion of the male member into the female member.

9. The quick release buckle as claimed in claim 1, wherein the installation feature of the U-shaped part is a hole penetrating and located in the central part of the U-shaped part.

10. The quick release buckle as claimed in claim 1, wherein the insertion guide surface includes a flat surface perpendicular to the insertion direction of the male member and a flat surface parallel to the insertion direction of the male member.

* * * * *